US009096290B2

(12) United States Patent
Harkness et al.

(10) Patent No.: US 9,096,290 B2
(45) Date of Patent: Aug. 4, 2015

(54) BOAT DRAIN PLUG STORAGE AND REMINDER DEVICE

(71) Applicants: Jon M. Harkness, Maple Grove, MN (US); Daniel J. Martinson, Medina, MN (US)

(72) Inventors: Jon M. Harkness, Maple Grove, MN (US); Daniel J. Martinson, Medina, MN (US)

(73) Assignee: IdeaForm Products LLC, Medina, MN (US)

( * ) Notice: Subject to any disclaimer, the term of this patent is extended or adjusted under 35 U.S.C. 154(b) by 48 days.

(21) Appl. No.: 14/135,868

(22) Filed: Dec. 20, 2013

(65) Prior Publication Data

US 2014/0261130 A1 Sep. 18, 2014

Related U.S. Application Data

(60) Provisional application No. 61/747,222, filed on Dec. 29, 2012.

(51) Int. Cl.
*B63B 13/00* (2006.01)

(52) U.S. Cl.
CPC ..... *B63B 13/00* (2013.01)

(58) Field of Classification Search
CPC ..... B63B 13/00
USPC ..... 114/197
See application file for complete search history.

(56) References Cited

U.S. PATENT DOCUMENTS

| | | | | | |
|---|---|---|---|---|---|
| 3,797,442 | A * | 3/1974 | McRae | 114/197 |
| 4,516,515 | A * | 5/1985 | Johnson | 114/197 |
| 4,542,373 | A * | 9/1985 | Hillock | 340/984 |
| 4,843,376 | A * | 6/1989 | Wagner et al. | 340/984 |
| 5,047,753 | A * | 9/1991 | Birchfield | 340/984 |
| 5,162,793 | A * | 11/1992 | Plost et al. | 340/984 |
| 5,182,556 | A * | 1/1993 | Plost et al. | 340/984 |
| 5,806,380 | A | 9/1998 | Wilsey | |
| 5,966,080 | A * | 10/1999 | Bigsby | 340/686.4 |
| 6,227,132 | B1 * | 5/2001 | Garcia | 114/197 |
| 6,695,661 | B1 * | 2/2004 | Navagh | 441/74 |
| 6,928,943 | B1 * | 8/2005 | Neubauer | 114/197 |
| 7,152,546 | B2 * | 12/2006 | Bernath | 114/197 |
| 7,191,722 | B1 * | 3/2007 | Plost | 114/197 |
| 7,316,195 | B2 * | 1/2008 | DeHart | 114/197 |
| 7,648,124 | B2 * | 1/2010 | Beers | 254/323 |
| 7,836,799 | B2 * | 11/2010 | Frank | 81/121.1 |
| 7,946,238 | B2 * | 5/2011 | Colsher et al. | 114/197 |
| 2014/0261130 | A1 * | 9/2014 | Harkness et al. | 114/221 R |

OTHER PUBLICATIONS

"Plug Caddy Drain Plug Holder" advertisement on eBay. Printed Dec. 9, 2013. http://www.ebay.com/itm/PLUG-CADDY-BOAT-DRAIN-PLUG-HOLDER-/200562468996.

* cited by examiner

*Primary Examiner* — Lars A Olson
*Assistant Examiner* — Jovon Hayes

(57) ABSTRACT

A storage device for holding a drain plug for a boat is disclosed. The storage device provides a place to store the drain plug when it is removed from a drain hole for the boat. The storage device includes a reminder system using an emergency stop lanyard (ESL) present on nearly all powerboats. The storage device holds both the ESL and the drain plug. The storage device is designed so that the ESL cannot be removed without first removing the drain plug. Thus, an operator cannot start a boat's engine without first removing the drain plug from the storage device to gain access to the ESL, allowing the ESL to be refitted onto an operating system for the boat's engine. The act of handling the drain plug reminds the operator to re-install the drain plug into the drain hole.

20 Claims, 5 Drawing Sheets

BOAT DRAIN PLUG STORAGE AND REMINDER DEVICE

CROSS REFERENCE TO RELATED APPLICATIONS

This application claims the benefit of Provisional Patent Application Ser. No. 61/747,222 filed on 29 Dec. 2012 by the first named inventor.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The present invention relates to a device for storing a drain plug for a boat when the drain plug is removed from a drain hole in the boat.

BACKGROUND OF THE INVENTION

Most boats have a drain hole located at a low point in a boat's hull to allow for the drainage of bilge water when the boat is removed from the water. Draining bilge water has long been viewed as a useful way to prevent damage that standing water can cause to a boat's interior. More recently, draining bilge water has come to be seen as an important way to limit the spread of aquatic invasive species (AIS) from infested to uninfested bodies of water. Driven by a concern to limit the spread of AIS, some laws have recently been enacted that require the drain plug to be removed from the boat whenever the boat is trailered on a public roadway.

Removing the drain plug when the boat is out of water has, therefore, long been a good idea, but now in some regions such removal is a legal requirement. But removing the drain plug creates challenges for a boat operator. First, a question arises of where the boat operator should store the drain plug when it is not in use. Second, the boat operator must remember to re-install the drain plug when the boat is re-launched to prevent the boat from taking on water, and possibly sinking.

The prior art includes some other boat drain plug storage devices, but these are generally not designed to remind the boat operator to reinstall the boat drain plug before launching the boat. The prior art also includes several devices designed to remind the boat operator to reinstall the drain plug before launching the boat, but these are generally somewhat complicated electrical and mechanical devices that are relatively costly and prone to malfunction.

SUMMARY OF THE INVENTION

A storage device for holding a drain plug for a boat embodying the principles of the invention incorporates an elegantly simple system to remind an operator to install the drain plug before launching the boat. This system takes advantage of an emergency stop lanyard (ESL) that is present on nearly all powerboats used in North America. The ESL (which is also referenced by a variety of other names such as "safety lanyard," "kill-switch tether," and "emergency engine cut-off device") is comprised of a cord with two ends. A clip designed to be attached to the operator is affixed to one end of the cord. A device that removably attaches to an element of a boat engine operating system is affixed to the other end of the cord. If the operator is somehow thrown from the boat, the ESL is designed to stay attached to the operator and pull free from the boat engine operating system. If the ESL is pulled from the boat engine operating system, the engine temporarily ceases to function.

When using the storage device embodying the principles of the invention, the operator purposefully removes the ESL from the boat engine operating system after removing the boat from a body of water, temporarily disabling the boat engine. The storage device is designed to hold both the ESL and the drain plug when the boat is out of the water. Further, the storage device is designed so that it is difficult or impossible for the operator to remove the ESL from the storage device without first removing the drain plug from the storage device.

Thus, the operator cannot start the boat engine without first removing the drain plug from the storage device to gain access to the ESL for re-installation on the boat engine operating system. The act of physically handling the drain plug to gain access to the ESL is meant to serve as a powerful reminder of the need to re-install the drain plug in a drain hole in the boat before leaving a landing for an outing on a body of water.

BRIEF DESCRIPTION OF THE SEVERAL VIEWS OF THE DRAWINGS

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
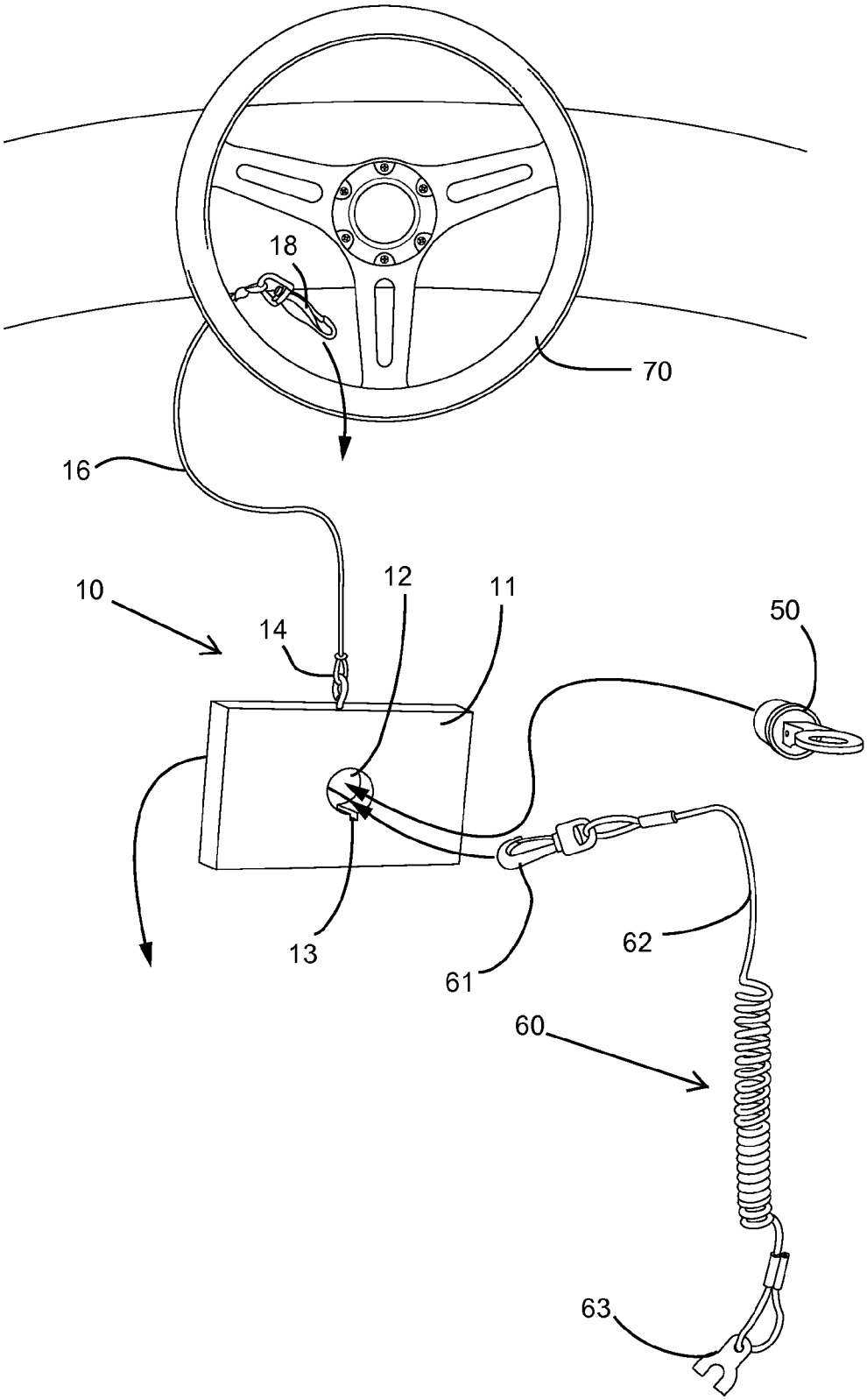
FIG. 1 is perspective view of one embodiment of the present invention before the storage device has been affixed into place on a boat, and before the ESL and the drain plug have been put into place on the storage device.

To provide an understanding of the basic principles of the invention, reference is made to the embodiments shown in the drawings, and specific terms will be employed to describe the same. It should be understood, however, that no limitation of the scope of the invention is thereby intended. Instead, the invention includes any and all such alterations and improvements of the illustrated device that would normally occur to one skilled in the art to which the invention relates.

Figure 2:
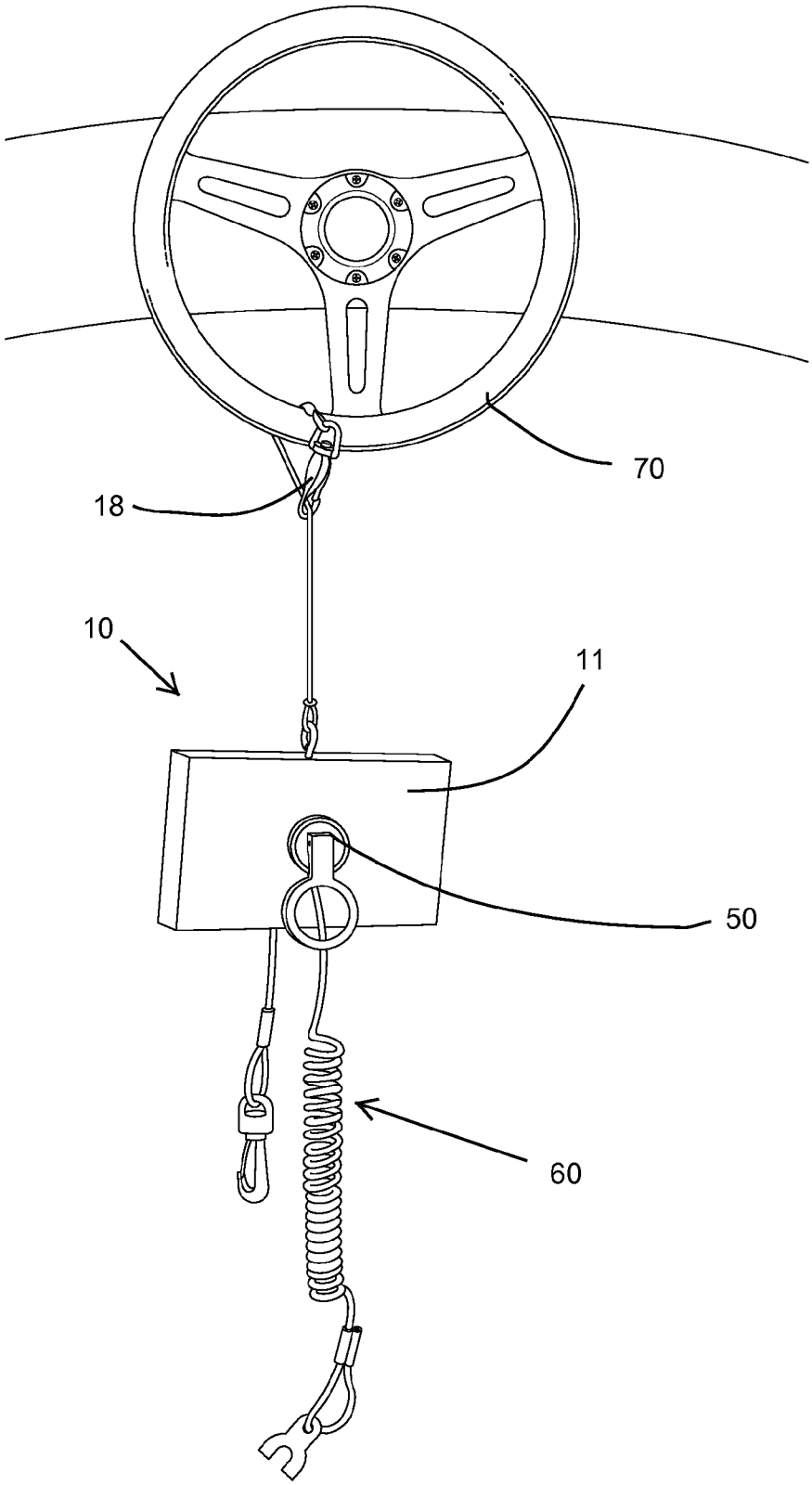
FIG. 2 is a perspective view of one embodiment of the present invention after the storage device has been affixed into place on the boat, and after the ESL and the drain plug have been put into place on the storage device.

FIGS. 1-2 show one embodiment of a storage device generally referred to as 10 for a drain plug 50 for a boat. The storage device 10 is comprised of a block 11 that includes a circular aperture 12 passing through the bock. The circular aperture 12 sized and structured to securely receive the drain plug 50. An interior surface of the circular aperture 12 can be threaded to accommodate a drain plug 50 of the type that screws into a threaded drain hole. In the embodiment shown in FIG. 1, the interior surface of the circular aperture 12 is generally smooth to accommodate a drain plug 50 of the type that is held into place by expanding to fit tightly into the drain hole. In the embodiment shown in FIGS. 1-2, the block 11 is rectangular in shape, but the block 11 could be made into a variety of different shapes.

A slot 13 is cut into an edge of the circular aperture 12. The slot 13 passes entirely through the block 11 and has a width and depth slightly greater than a diameter of a cross-section of a cord 62 of an emergency stop lanyard (ESL) 60 for the boat. To use this embodiment of the storage device 10, an operator passes an end of the ESL 60 through the circular aperture 12 and nests the cord 62 of the ESL 60 in the slot 13. FIG. 1 shows an operator clip end 61 of the ESL 60 being passed through the circular aperture 12. Alternatively, an engine cut-off end 63 of the ESL 60 could be passed through the circular aperture 12.

After the cord 62 is nested within the slot 13, the operator securely affixes the drain plug 50 into the circular aperture 12. FIG. 2 shows the ESL 60 held in the storage device 10 after the drain plug 50 has been placed into the circular aperture 12. The ends (61 and 63) of the ESL 60 are too large to pass through slot 13 after the drain plug 50 has filled the circular aperture 12. The ESL 60 is, thus, trapped in the storage device 10, making it impossible for the operator to gain access to the ESL 60 without first removing the drain plug 50 from the storage device 10.

In the embodiment shown in FIGS. 1-2, the boat drain plug storage device 10 is removably affixed to a steering wheel 70 of a boat by means of a tether 16 having a block end 14 permanently affixed to the block 11 and a clip end 18. As shown in FIG. 1, the clip end 18 can be wrapped around the steering wheel 70. As shown in FIG. 2, the clip end 18 can then be removably clipped to the tether 16, allowing the storage device 10 to dangle from the steering wheel 70 while the storage device 10 is in use. The tether 16 could be similarly clipped to other parts of the boat, such as a throttle control lever or a tiller handle. The storage device 10 could also be removably affixed to any of a number of other parts of the boat by other means such as a carabineer-like device. Alternatively, the boat drain plug storage device 10 could be permanently affixed to the boat in a location such as the dashboard. In yet another alternative embodiment, the storage device 10 could be either temporarily or permanently affixed to a part of the boat trailer or the boat trailer straps.

Figure 3:
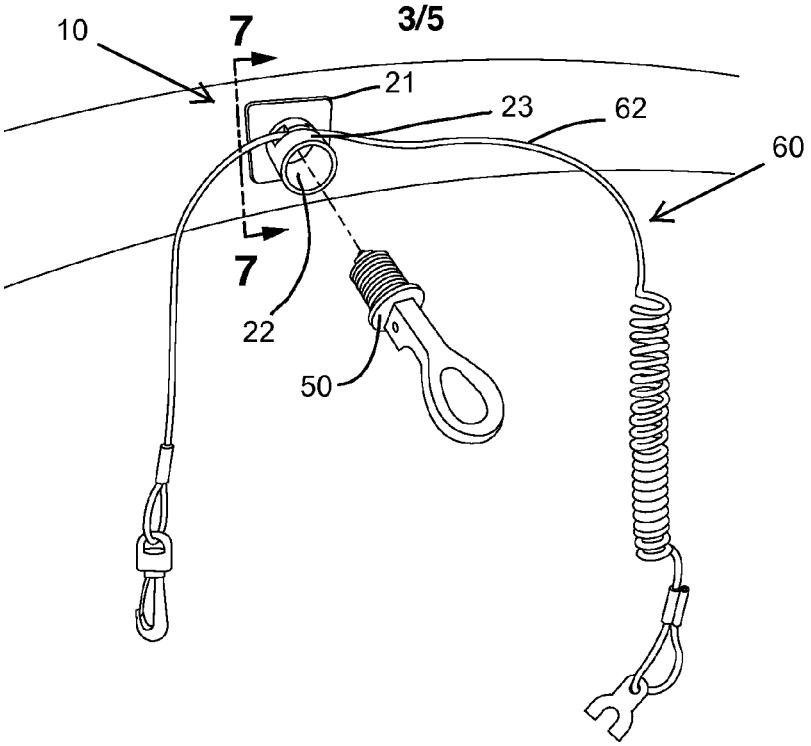
FIG. 3 is a perspective view of one embodiment of the present invention with the storage device affixed to a surface, with the ESL placed in the storage device and before the drain plug has been placed in the storage device.
Figure 4:
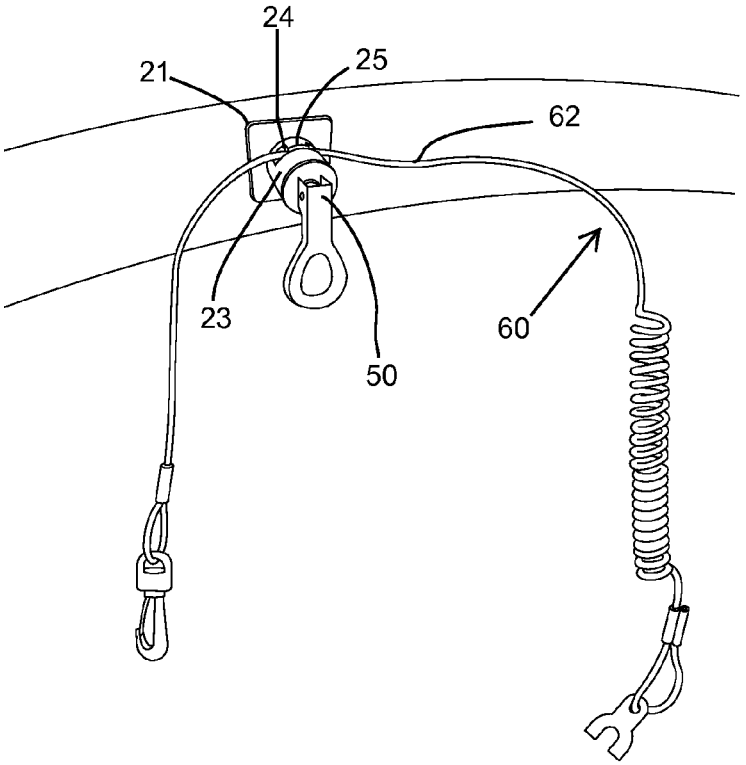
FIG. 4 is a perspective view of one embodiment of the present invention with the storage device affixed to a surface, with the ESL and the drain plug placed in the storage device.
Figure 7:
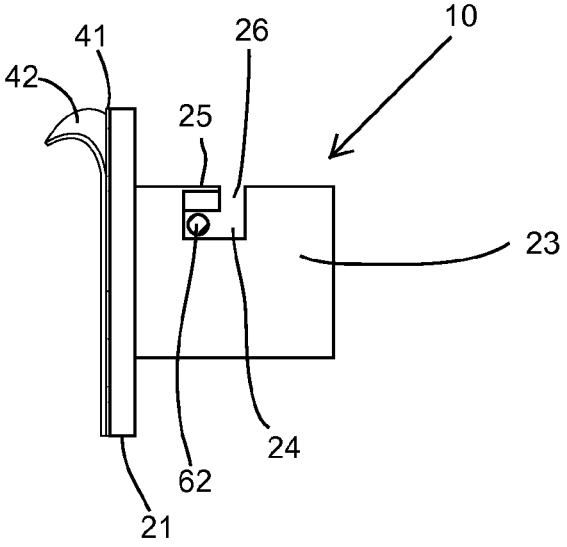
FIG. 7 is a sectional view taken about the line 7-7 and in the direction of the arrows as indicated about the section line in FIG. 3.

FIGS. 3, 4, and 7 show an alternative embodiment of the storage device 10. In this embodiment, the storage device 10 is comprised of a base 21 and a circular tube 23 protruding perpendicularly from the base 21. The circular tube 23 is sized and structured to securely receive the drain plug 50. An interior surface of the circular tube 23 can be threaded to accommodate a drain plug 50 of the type that screws into a threaded drain hole. In the embodiment shown in FIG. 3, the interior surface of the circular tube 23 is generally smooth to accommodate a drain plug 50 of the type that is held into place by expanding to fit tightly into the drain hole.

A window 24 is cut through a side of the circular tube 23 in proximity to the base 21. The window 24 has a width slightly greater than double the diameter of the cross-section of the cord 62 of the ESL 60 and a length slightly less than a circumference of the circular tube 23. A window tab 25 protrudes into the window 24 from a center point of a side of the window 24 nearest the base 21. The window tab 25 protrudes roughly halfway into the window 24 toward a side of the window 24 opposite the base 21. The window tab 25 spans roughly a central third of the length of the window.

To use this embodiment of the storage device 10, the operator presses the cord 62 of the ESL 60 into a gap 26 between the window tab 25 and the side of the window 24 opposite the base 21. The operator then slides the cord 62 within the window 24 toward the base 21, lodging the cord 62 beneath the window tab 25. The operator then firmly secures the drain plug 50 in the circular tube 23 so that the drain plug 50 blocks the gap 26 between the window tab 25 and the side of the window 24 opposite the base 21. The ESL 60 is, thus, trapped in the storage device 10, making it impossible for the operator to gain access to the ESL 60 without first removing the drain plug 50 from the storage device 10.

In the embodiment shown in FIGS. 3, 4, and 7, the storage device 10 is affixed to the boat (or a trailer for the boat) by means of an adhesive 41 on a side of the base 21 opposite the circular tube 23. The storage device 10 can be affixed in place by peeling a protective backing 42 from the adhesive 41 and sticking the storage device 10 onto a desired location. This embodiment of the storage device 10 could be temporarily or permanently installed by a variety of other attachment means including screws, rivets, and the like. The structure of the storage device 10 could also be molded or otherwise constructed to be an integral part of the boat or the trailer for the boat.

Figure 5:
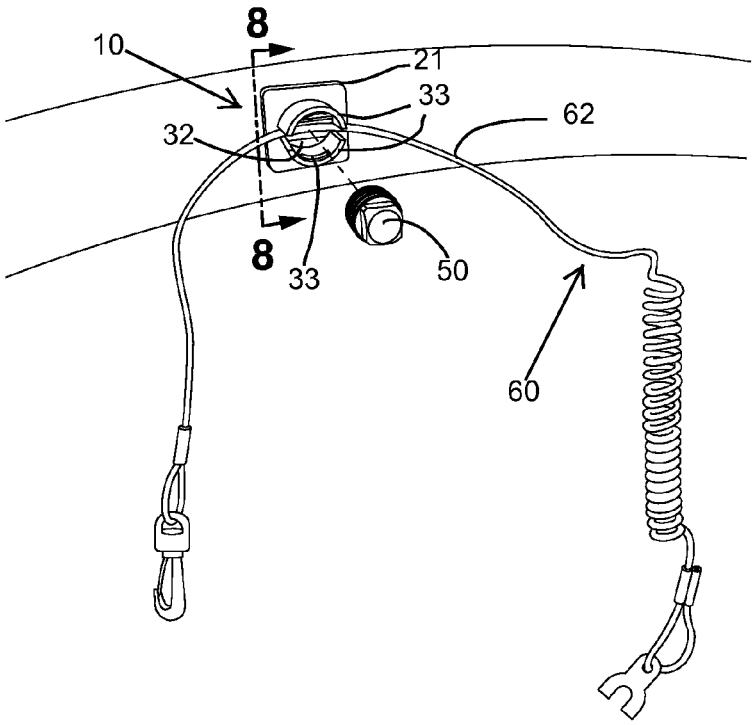
FIG. 5 is a perspective view of one embodiment of the present invention with the storage device affixed to a surface, with the ESL placed into the storage device and before the drain plug has been placed in the storage device.
Figure 6:
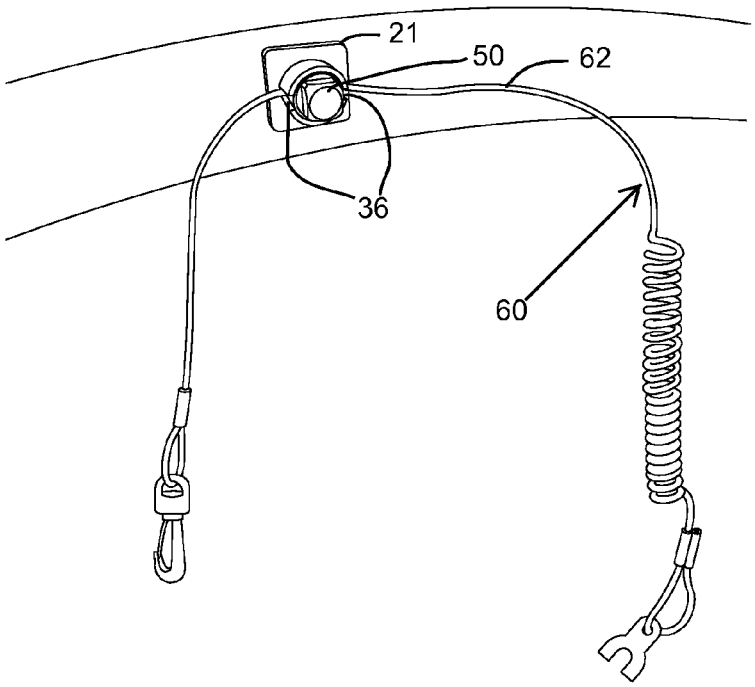
FIG. 6 is a perspective view of one embodiment of the present invention with the storage device affixed to a surface, with the ESL and the drain plug placed in the storage device.
Figure 8:
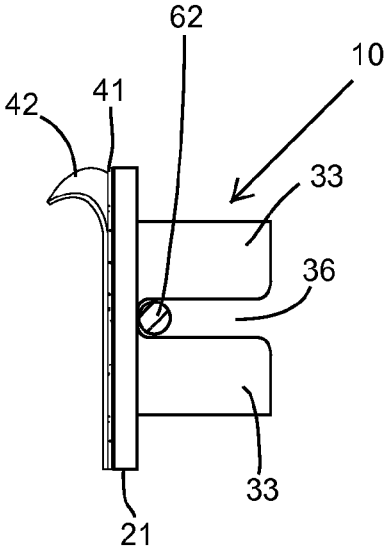
FIG. 8 is a sectional view taken about the line 8-8 and in the direction of the arrows as indicated about the section line in FIG. 5.

FIGS. 5, 6, and 8 show another alternative embodiment of the storage device 10. In this embodiment, the storage device 10 is comprised of the base 21 and a pair of opposing curved sidewalls 33 protruding perpendicularly from the base 21 to form an interrupted circular aperture 32 interrupted on opposite sides by a pair of opposing slots 36. The interrupted circular aperture 32 is sized and structured to securely receive the drain plug 50. In the embodiment most clearly shown in FIG. 5, a curved flange 33 is formed on an interior surface of each of the pair opposing curved sidewalls 33. Each of the curved flanges 33 is sized and angled to securely receive the drain plug 50 when the drain plug is of the type to be screwed into the drain hole for the boat. Alternative means of placing threads in the interrupted circular aperture 32 are included within the scope of the present invention. The interior surface of the interrupted circular aperture 32 could also be generally smooth to receive the drain plug 50 when the drain plug is of the type that is held into place by expanding to fit tightly into the drain hole for the boat. Each of the pair of opposing slots 36 that interrupt the interrupted circular aperture 32 has a width slightly greater than the diameter of the cord 62 of the ESL 60.

To use this embodiment of the storage device 10, the operator nests the cord 62 of the ESL 60 into the pair of opposing slots 36 so that the cord 62 spans the interrupted circular aperture 32 adjacent the base 21. The operator then firmly secures the drain plug 50 in the circular aperture atop the cord 62. The ESL 60 is, thus, trapped in the storage device 10, making it impossible for the operator to gain access to the ESL 60 without first removing the drain plug 50 from the storage device 10.

In the embodiment shown in FIGS. 5, 6, and 8, the storage device 10 is affixed to the boat (or the trailer for the boat) by means of an adhesive 41 on a side of the base 21 opposite the pair of opposing curved sidewalls 33. The storage device 10 can be affixed in place by peeling the protective backing 42 from the adhesive 41 and sticking the storage device 10 onto a desired location. This embodiment of the storage device 10 could be temporarily or permanently installed by a variety of other attachment means including screws, rivets, and the like. The structure of the storage device 10 could also be molded or otherwise constructed to be an integral part of the boat or the trailer for the boat.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular exemplary embodiments but that the invention will include all embodiments falling with the scope of the appended claims.

What is claimed is:

1. A storage device for holding a drain plug for a boat, the storage device comprising:

a. a circular aperture, the circular aperture sized and structured to securely receive the drain plug; and b. a means for retaining an emergency stop lanyard (ESL) for the boat, the means for retaining the ESL in communication with the circular aperture, the means for retaining the ESL structured and positioned so that an operator cannot remove the ESL from the storage device until the operator first removes the drain plug from the circular aperture.

2. The storage device of claim 1, wherein the storage device includes a means for temporarily attaching the storage device to the boat or to a trailer for the boat.

3. The storage device of claim 2, wherein the means for temporarily attaching the storage device to the boat or to a trailer for the boat is comprised of a tether and a clip.

4. The storage device of claim 2, wherein the means for temporarily attaching the storage device to the boat or to a trailer for the boat is comprised of a carabineer mechanism.

5. The storage device of claim 1, wherein the storage device includes a means for permanently attaching the storage device to the boat or to a trailer for the boat.

6. The storage device of claim 5, wherein the means for permanently attaching the storage device to the boat or to a trailer for the boat is comprised of an adhesive.

7. The storage device of claim 1, wherein the storage device is a permanent part of the boat or a trailer for the boat.

8. A storage device for holding a drain plug for a boat and an emergency stop lanyard (ESL) for the boat, the storage device comprising:

a. a block, the block having a thickness approximately equal to a depth of the drain plug;

b. a circular aperture passing entirely through the block, the circular aperture sized and structured to securely receive the drain plug;

c. a slot cut into an edge of the circular aperture, the slot passing entirely through the block and the slot having a width and a length slightly greater than a diameter of a cord of the ESL;

d. whereby an operator can first position the cord of the ESL in the slot, after the operator has passed an end of the ESL through the circular aperture;

e. whereby the operator can then firmly secure the drain plug in the circular aperture;

f. thereby trapping the ESL in the slot; and g. whereby the operator cannot later remove the ESL from the storage device until the operator first removes the drain plug from the circular aperture.

9. The storage device of claim 8, wherein the storage device includes a means for attaching the storage device to the boat or to a trailer for the boat.

10. The storage device of claim 9, wherein the means for attaching the storage device to the boat or to a trailer for the boat is comprised of a tether and a clip.

11. The storage device of claim 9, wherein the means for attaching the storage device to the boat or to a trailer for the boat is comprised of a carabineer mechanism.

12. The storage device of claim 8, wherein the storage device is a permanent part of the boat or a trailer for the boat.

13. A storage device for holding a drain plug for a boat and an emergency stop lanyard (ESL) for the boat, the storage device comprising:

a. a base;

b. a circular tube protruding perpendicularly from the base, the circular tube sized and structured to securely receive the drain plug;

c. a window, the window cut through a side of the circular tube in proximity to the base, the window having a width slightly greater than double a diameter of a cord of the ESL, and the window having a length spanning slightly less than half a circumference of the circular tube;

d. a window tab, the window tab protruding into the window from a center of a side of the window nearest the base; the window tab protruding roughly halfway into the window toward a side of the window opposite the base; and the window tab spanning roughly a central third of the length of the window;

e. whereby an operator can press a midsection of the ESL into a gap between the window tab and the side of the window opposite the base;

f. whereby the operator can then slide the cord of the ESL within the window toward the base, lodging the cord beneath the window tab;

g. whereby the operator can then firmly secure the drain plug in the circular tube, so that the drain plug blocks the gap between the window tab and the side of the window opposite the base;

h. thereby trapping the ESL in the storage device; and i. whereby the operator cannot later remove the ESL from the storage device until the operator first removes the drain plug from the circular tube.

14. The storage device of claim 13, wherein the storage device includes a means for attaching the storage device to the boat or to a trailer for the boat.

15. The storage device of claim 14, wherein means for attaching the storage device to the boat or to a trailer for the boat the storage device is an adhesive on a side of the base opposite the circular tube.

16. The storage device of claim 13, wherein the storage device is a permanent part of the boat or a trailer for the boat.

17. A storage device for holding a drain plug for a boat and an emergency stop lanyard (ESL) for the boat, the storage device comprising:

a. a base;

b. a pair of opposing curved sidewalls, each of the curved sidewalls protruding perpendicularly from the base and forming an interrupted circular aperture interrupted on opposite sides by a pair of opposing slots;

c. the interrupted circular aperture sized and structured to securely receive the drain plug;

d. each of the pair of opposing slots having a width slightly greater than a diameter of a cord of the ESL;

e. whereby an operator can nest the cord of the ESL into the pair of opposing slots so that the cord spans the interrupted circular aperture adjacent the base;

f. whereby the operator can then firmly secure the drain plug in the interrupted circular aperture atop the midsection of the ESL;

g. thereby trapping the ESL in the pair of opposing slots; and h. whereby the operator cannot later remove the ESL from the storage device until the operator first removes the drain plug from the interrupted circular aperture.

18. The storage device of claim 17, wherein the storage device includes a means for attaching the storage device to the boat or to a trailer for the boat.

19. The storage device of claim 18, wherein means for attaching the storage device to the boat or to a trailer for the boat the storage device is an adhesive on a side of the base opposite the curved sidewalls.

20. The storage device of claim 17, wherein the storage device is a permanent part of the boat or a trailer for the boat.

* * * * *